US009212034B2

(12) United States Patent
Hystad

(10) Patent No.: US 9,212,034 B2
(45) Date of Patent: Dec. 15, 2015

(54) SELECTIVELY ENGAGEABLE CHAIN WILDCAT

(75) Inventor: Geir Hystad, Kopervik (NO)

(73) Assignee: KARM AS, Kopervik (NO)

( * ) Notice: Subject to any disclaimer, the term of this patent is extended or adjusted under 35 U.S.C. 154(b) by 157 days.

(21) Appl. No.: 13/695,894

(22) PCT Filed: Apr. 18, 2011

(86) PCT No.: PCT/NO2011/000132

§ 371 (c)(1),
(2), (4) Date: Jan. 7, 2013

(87) PCT Pub. No.: WO2011/139156

PCT Pub. Date: Nov. 10, 2011

(65) Prior Publication Data

US 2013/0105750 A1 May 2, 2013

(30) Foreign Application Priority Data

May 4, 2010 (NO) ..... 20100639

(51) Int. Cl.

| | |
|---|---|
| ***B63B 21/16*** | (2006.01) |
| ***B66D 1/72*** | (2006.01) |
| ***B63B 21/22*** | (2006.01) |
| ***B66D 1/54*** | (2006.01) |

(52) U.S. Cl.
CPC . *B66D 1/72* (2013.01); *B63B 21/16* (2013.01); *B63B 21/22* (2013.01); *B66D 1/54* (2013.01)

(58) Field of Classification Search
USPC ..... 254/371, 372, 358, 408
See application file for complete search history.

(56) References Cited

U.S. PATENT DOCUMENTS

| | | | | |
|---|---|---|---|---|
| 3,744,760 | A * | 7/1973 | Uher | 254/351 |
| 4,878,452 | A * | 11/1989 | Regan et al. | 114/293 |
| 4,915,357 | A * | 4/1990 | Valentinsen | 254/266 |
| 5,271,608 | A * | 12/1993 | Kubono | 254/372 |
| 5,474,278 | A * | 12/1995 | Cleveland | 254/334 |
| 6,394,421 | B1 | 5/2002 | Henley | |
| 7,104,214 | B2 * | 9/2006 | Niebur | 114/230.2 |

FOREIGN PATENT DOCUMENTS

WO WO 01/14240 A1 3/2001

* cited by examiner

*Primary Examiner* — William A Rivera
*Assistant Examiner* — Angela Caligiuri
(74) *Attorney, Agent, or Firm* — Knobbe, Martens, Olson & Bear, LLP

(57) ABSTRACT

A chain wildcat comprising an intermediate piece with an inner central part about which the chain wildcat can rotate freely after disengagement of a grip configured for attachment to a drive shaft in an anchor handling winch, the intermediate piece comprising an additional central part configured for fixed connection to the drive shaft.

9 Claims, 2 Drawing Sheets

SELECTIVELY ENGAGEABLE CHAIN WILDCAT

CROSS-REFERENCE TO RELATED APPLICATIONS

This application is the U.S. National Phase under 35 U.S.C. §371 of International Application PCT/NO2011/000132, filed Apr. 18, 2011, which claims priority to NO 20100639, filed May 4, 2010.

STATEMENT REGARDING FEDERALLY SPONSORED R&D

Not Applicable

PARTIES OF JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a chain wildcat for an anchor handling winch, and more specifically it relates to a chain wildcat, preferably for removable attachment to an end of a drive shaft in an anchor handling winch for adapting the anchor handling winch to chain of different dimensions. The invention further relates to an anchor handling winch equipped with a chain wildcat.

2. Description of the Related Art

Put briefly, a wildcat is the drum or wheel that heaves in the chain, where the drum or wheel is advantageously provided with at least five pockets that engage the chain links. Different chain dimensions therefore require the use of different-size pockets.

The international standard ISO 7365 relating to winches for towing and anchor handling vessels refers to emergency release in general without distinguishing between wires and chain, and is therefore regarded as unsuitable or insufficient as regards anchor handling winches equipped with both wire drum and chain wildcat. For a wire drum, it is a requirement that the drum can be placed in neutral within a maximum number of seconds, but for a chain wildcat there is at present so such requirement.

Inadequate requirements for placing a chain wildcat in neutral lead to a risk of an anchor handling vessel foundering, especially when working against the towline, because many anchor handling vessels in that situation have sufficient transverse force to capsize the vessel. This problem is described in more detail by the English textbook author on ship stability, Ian Clark.

On previously known anchor handling winches, the wildcat is typically loose, and is attached to the end of a drive shaft which often has a pentagonal, key or spline connection. The said winches further typically consist of a drive unit which drives the drive shaft, where a disengageable wire drum is connected to the drive shaft, and also where different removable wildcats can be mounted to the end of the drive shaft equipped with a journal so as to enable the vessel to handle several different chain dimensions.

Other systems are previously known where the whole of the drive shaft is disengageable in relation to the drive unit, but as far as the applicant is aware none are known where the wildcat itself can be disengaged from the drive shaft, in an emergency release, for example, to prevent the vessel from capsizing.

BRIEF SUMMARY OF THE INVENTION

As mentioned above, requirements are set as regards the possibility of disengaging the wire drum, but no similar requirements are made as regards disengaging the chain wildcat. To solve the problems this causes, it is an object of the present invention to provide a disengageable chain wildcat which also can be used on existing anchor handling winches, characterized in that the chain wildcat (7, 7') comprises an intermediate piece (8; 8') with an inner central part (12; 12') about which the chain wildcat (7; 7') can rotate freely after disengagement of gripping means (11; an emergency comprising an additional central part (9; 9') for fixed connection to the drive shaft (1), and an anchor handling winch equipped with the disengageable chain wildcat.

Advantageous embodiments of the invention are set forth in the dependent claims.

BRIEF DESCRIPTION OF THE DRAWINGS

The present invention is described in more detail in the following, with reference to the attached drawings of non-limiting exemplary embodiments of the invention, and wherein.

DETAILED DESCRIPTION

Figure 1:
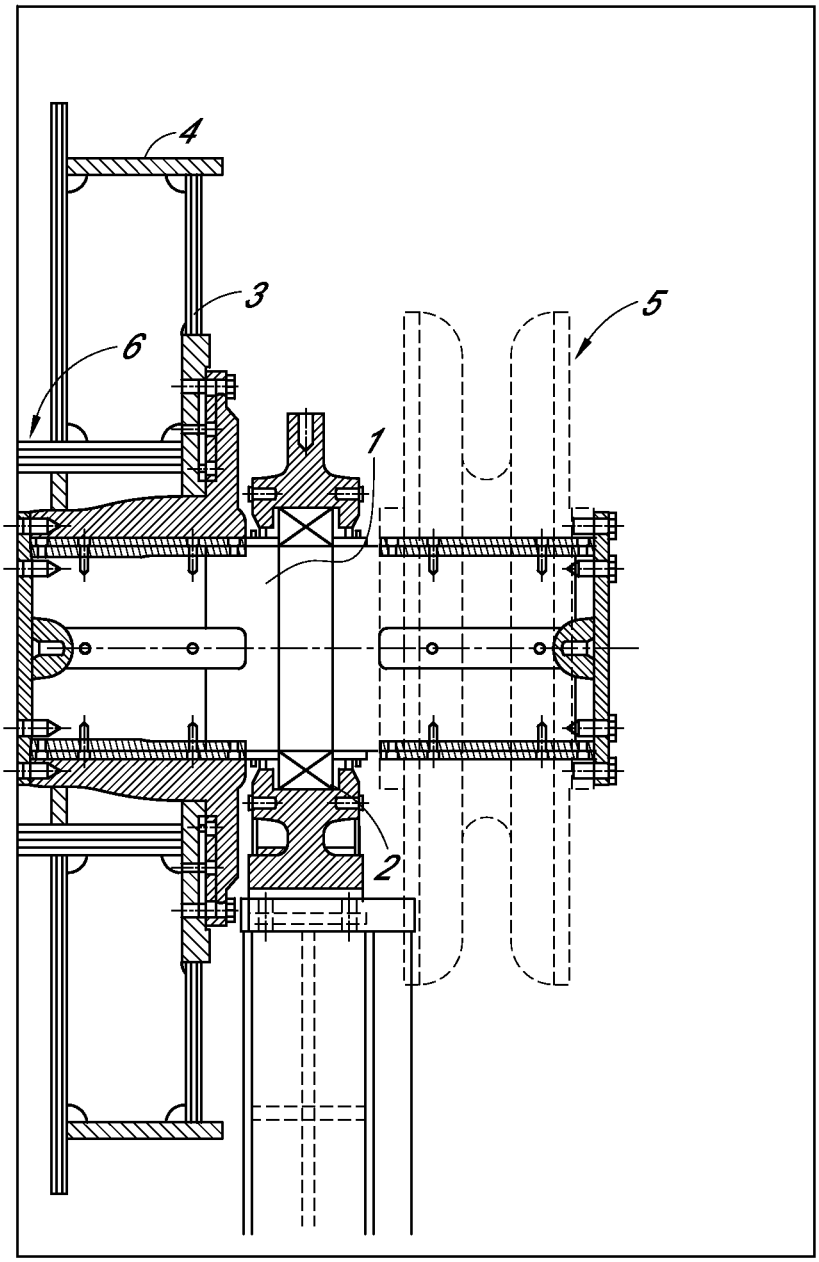
FIG. 1 (Prior Art)
FIG. 1 is a side view of a part of the drive shaft of a prior art anchor handling winch, where attached to the drive shaft is a wire drum connected to a brake drum shown on the left-hand side of the figure, and where on the right-hand side of the figure there is indicated in broken lines a connection of chain wildcat to one end of the drive shaft.

In the following description, a part or an element of the second embodiment having the same or similar function as a part or element of the first embodiment is indicated by the same reference numeral, but followed by an apostrophe (').

FIG. 1 shows in principle a part of a typical prior art anchor handling winch, and also shows a part of a drive shaft 1, a bearing 2 for the drive shaft 1, and a brake drum 3 with a braking surface 4 for the anchor handling winch secured to a part of the drive shaft 1. Attachment of a chain wildcat 5 to an end of the drive shaft 1 is further indicated in broken lines. The wire drum 6 of the anchor handling winch is only just visible in the figure, and is typically disengageably attached to the drive shaft 1 in association with the brake drum 3. For controlled braking of the anchor handling winch, a non-illustrated brake shoe is brought into variable pressing abutment against the braking surface 4.

Figure 2:
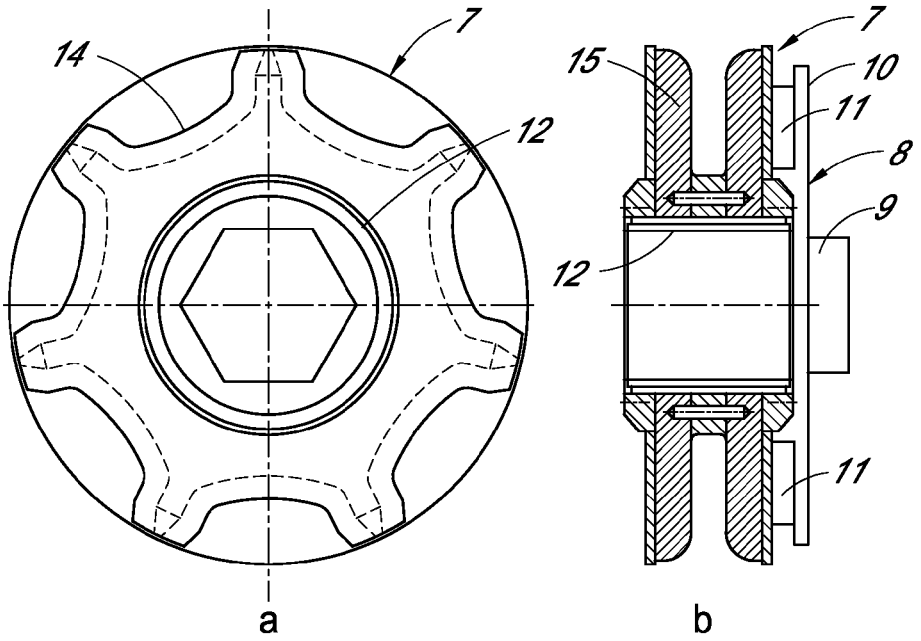
FIGS. 2*a* and *b* are respectively a side view and an axial cross-section of a first embodiment of a chain wildcat according to the invention.

FIGS. 2*a* and *b* show in principle a first embodiment of a disengageable chain wildcat 7 according to the present invention where between the wildcat 7 and the drive shaft 1 there is arranged an intermediate piece 8 with a sleeve-shaped part 9 fixedly attached to the end of the drive shaft 1, and with a plate-like part 10 radially extending from the sleeve-shaped part 9 for disengageable connection to the wildcat 7. Disengageable fasteners between the wildcat 7 and the intermediate piece are indicated by means of the reference numeral 11 in the figure, and may be hydraulically, pneumatically or electrically activated by input via a non-illustrated swivel or slip ring connection in a way that will be obvious to those of skill in the art in the light of the description and drawings. There will preferably be at least three disengageable fasteners 11 spaced apart equidistantly in a radial direction on the plate-like part 10, and after disengagement of the fasteners 11, the wildcat 7 will rotate freely on another sleeve-shaped part 12 of the intermediate piece 8.

Figure 3:
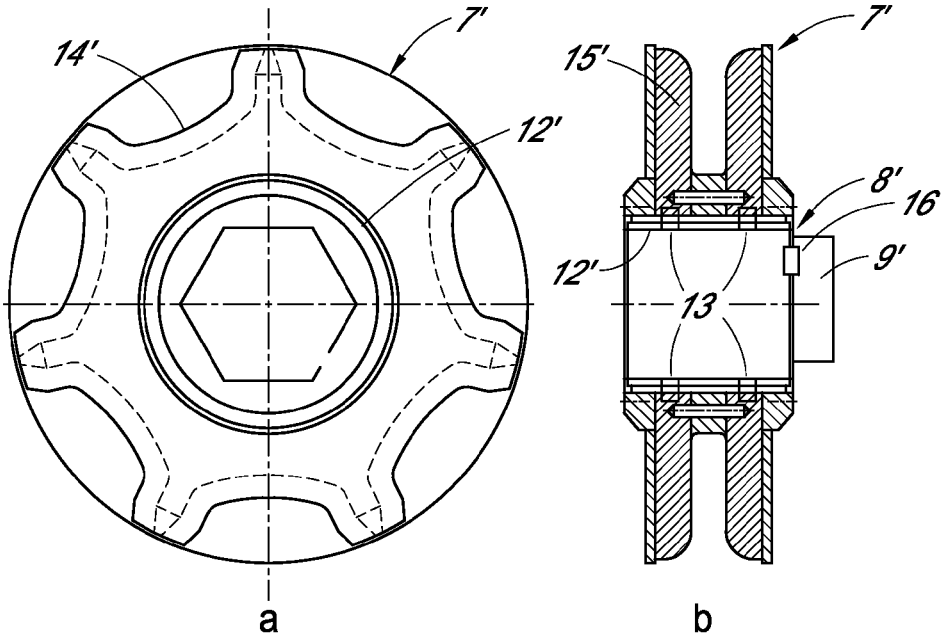
FIGS. 3*a* and *b* are respectively a side view and an axial cross-section of a second embodiment of a chain wildcat according to the invention.

FIGS. 3*a* and *b* show in principle a second embodiment of a disengagable chain wildcat 7' according to the present invention where between the wildcat 7' and the drive shaft 1 there is arranged an intermediate piece 8' with a sleeve-shaped part 9' fixedly attached to the end of the drive shaft 1, and where the intermediate piece 8' further comprises a control unit, for example, a radio receiver 16 for remote detonation of explosively releasable bolts 13 arranged between the intermediate piece 8' and the wildcat 7' with the aid of radio signals, and where, after detonation of the bolts 13, the wildcat 7' will rotate freely on another sleeve-shaped part 12' of the intermediate piece 8'.

In both FIGS. 2*a* and 3*a*, the pockets 14, 14' of the chain wildcat 7, 7' are in respective side walls 15, 15' and adapted to a given chain dimension indicated in broken lines.

The energy for disengaging the wildcat 7, 7' may thus either be stored in the wildcat itself or be suppliable via a (non-illustrated) swivel or slip ring, for example, via hydraulic oil, air or as electric current. Stored energy in the wildcat may typically be in the form of (non-illustrated) springs, accumulator, battery or explosive material. This energy may further be controlled at a distance through (non-illustrated) hydraulic, pneumatic, electric, radio, acoustic or mechanical control/transfer. For the actual disengagement, it is conceivable to have in addition to, or instead of, the illustrated detonatable bolts 13, (non-illustrated) shear pins, splines, key connections, hydrodynamic locking devices, friction-braking devices and/or claw couplings.

According to the present invention, increased safety will be obtainable for a towing or anchor handling vessel in that the vessel can be disengaged from the chain line to the same extent as it can be disengaged from a wire line.

The chain wildcat according to the invention is intended to be capable of being retrofitted on existing anchor handling winches, and will thus also increase the safety of these winches.

The invention is not limited to the illustrated embodiments, but can be varied within the is scope of the attached claims.

What is claimed is:

1. A chain wildcat configured for removable attachment to an end of a drive shaft in an anchor handling winch comprising an intermediate piece with an inner central part and a plate-like part radially extending from the inner central part, wherein the plate-like part is configured for attachment to the drive shaft by a sleeve-shaped part, wherein the intermediate piece, the plate-like part and the sleeve-shaped part rotate as one unit on the drive shaft, and wherein the intermediate piece is connected to the chain wildcat by disengageable fasteners that connect the plate-like part to the chain wildcat such that the chain wildcat rotates freely after disengagement of the disengageable fasteners, the intermediate piece comprising an additional central part configured for fixed connection to the drive shaft;

wherein the disengageable fasteners are hydraulically, pneumatically or electrically activated by input via a swivel or slip ring connection, and wherein there are at least three disengageable fasteners spaced apart equidistantly in the radial direction on the plate-like part; or wherein, between the chain wildcat and the inner central part of the intermediate piece, the disengageable fasteners are provided in the form of explosively releasable bolts, the intermediate piece further including a radio receiver for remote detonation of the bolts with the aid of radio signals.

2. A method of operating an anchor handling winch comprising:

providing the chain wildcat according to claim 1 and the anchor handling winch, and using said chain wildcat in association with the anchor handling winch.

3. The method of claim 2, wherein the wildcat is disengaged from a drive shaft of the anchor handling winch to allow emergency release in an emergency situation.

4. The method of claim 3, wherein said emergency situation is a danger of vessel capsize.

5. The chain wildcat according to claim 1, wherein the disengageable fasteners are in the form of or comprise shear pins, splines, key connections, hydrodynamic locking devices, friction braking devices or claw couplings.

6. The chain wildcat according to claim 1, wherein the chain wildcat is configured to be retrofit to the anchor handling winch.

7. An anchor handling winch, comprising the chain wildcat according to claim 1.

8. The anchor handling winch according to claim 7, wherein the drive shaft of the anchor handling winch comprises a wire drum to which is connected a brake drum comprising a braking surface.

9. The chain wildcat of claim 1, wherein the chain wildcat functions with chains of different dimensions.

* * * * *